United States Patent [19]

Steger

[11] 4,056,067

[45] Nov. 1, 1977

[54] JOINT FOR MODULAR FURNITURE

[76] Inventor: Thomas C. Steger, Goose Hill Road, Chester, Conn. 06412

[21] Appl. No.: 693,474

[22] Filed: June 7, 1976

[51] Int. Cl.[2] ..... A47B 57/00; A47B 87/00

[52] U.S. Cl. ..... 108/101; 108/111; 312/111; 403/408

[58] Field of Search ..... 312/111, 140, 108; 297/440; 108/101, 111; 403/408, 378, 379, 388; 52/758 F, 753 E, 753 G; 206/821

[56] References Cited

U.S. PATENT DOCUMENTS

| | | | |
|---|---|---|---|
| 916,553 | 3/1909 | Heap | 52/753 E |
| 3,125,385 | 3/1964 | Friedman | 312/111 |
| 3,730,601 | 5/1973 | Misenheimer | 312/108 |

OTHER PUBLICATIONS

"Reference for Wood" by E. Sloane, Ballantine Books, 23721, © 1965, The Offset Pin Section.

*Primary Examiner*—Paul R. Gilliam
*Assistant Examiner*—Alex Grosz
*Attorney, Agent, or Firm*—Dike, Bronstein, Roberts, Cushman & Pfund

[57] ABSTRACT

A furniture joint for assembling shelves in spaced parallel relation on supporting spindles to form a standing tier of shelves of appropriate height without the aid of fastening elements and/or tools.

3 Claims, 6 Drawing Figures

JOINT FOR MODULAR FURNITURE

BACKGROUND OF INVENTION

Most furniture joints are fixed by means of adhesive or joined by means of dowel and hole construction, tongue and groove construction, screws, bolts, friction sleeves, pins and the like, none of which are appropriate to furniture which is delivered knocked-down to the customer for erection, particularly when such furniture is supplied in modular form to enable from time-to-time adding or removing modules. While the joint herein illustrated is designed specifically for knocked-down furniture of the modular type, it can also be used in the construction of furniture by the manufacturer in place of conventional joints with the advantage that if it becomes necessary to disassemble the furniture for the purpose of repair, transportation or storage, such disassembly may be achieved easily without the aid of special tools and reassembled after repair without the aid of special fastenings and/or tools.

SUMMARY OF INVENTION

In an article of furniture, a part to which the ends of pairs of structural elements are to be joined, joint means for joining said ends to said part comprising means defining spaced openings in the part, and connector means containing spaced openings disposed in engagement with the part with the holes in the part and the holes in the connector means superimposed characterized in that the spacing of the holes in the part and the spacing of the holes in the connector means is slightly different such that the ends of the structural elements when inserted through the holes in the connector means into the holes in the part are stressed in bending in opposite directions. Specifically, the part may be a shelf member and the structural elements spindles at the opposite ends of the shelf member to which the shelf member is adapted to be mounted. The shelf member contains spaced holes at its opposite ends and the connector means comprise blocks containing spaced holes arranged at the opposite ends so that the holes in the shelf member and the holes in the connector are superimposed. Two or more shelf members may be mounted in spaced parallel relation by inserting the upper ends of the spindle into the holes in the connectors at the underside of the shelf member above and by inserting the lower ends of the spindles into the holes in the shelf member from which the spindles rise. The connectors for this purpose have holes at their top and bottom sides. A modular structure may thus be constructed wherein each module comprises a shelf member, connectors and spindles so that they may be superimposed to form a standing tier of shelves. The distance between the holes in the pairs of holes in the shelf members and the holes in the pairs of holes in the connectors may be greater or lesser than one another.

The invention will now be described in greater detail with reference to the accompanying drawings wherein.

Figure 1:
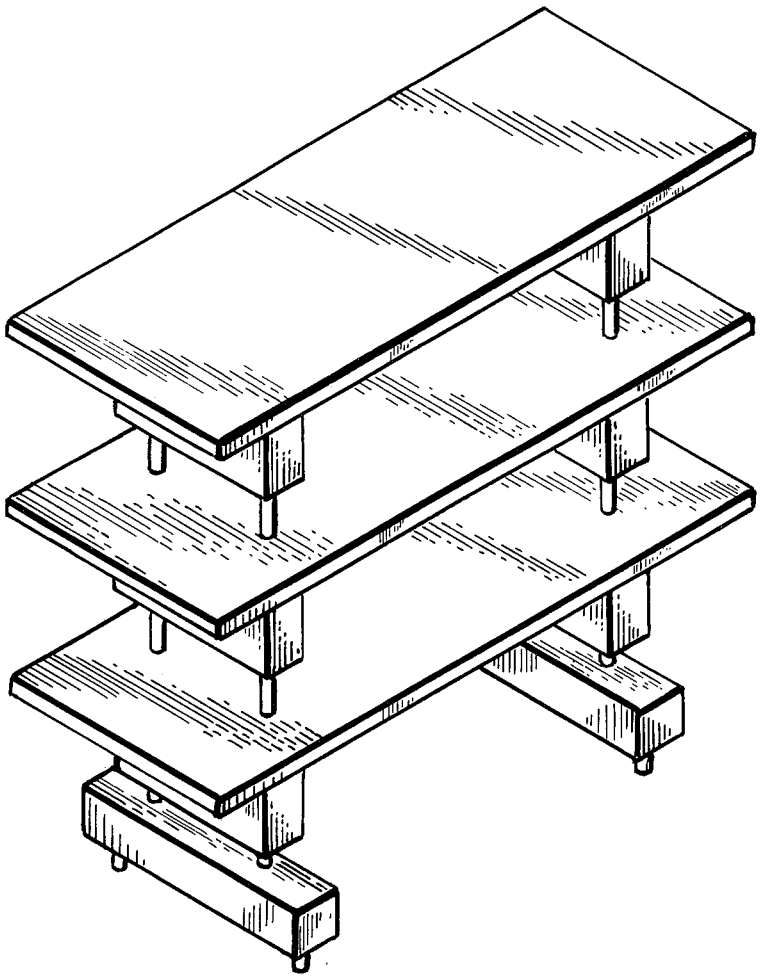
FIG. 1 is a perspective view of an article of furniture embodying the joint structure of this invention.

The joint herein disclosed is especially suitable for modular furniture and for the purpose of illustration is embodied in a free-standing tier of shelves. Referring to the drawings FIGS. 1, 2 and 3, the tier of shelves is comprised of three modular units 10, each of which comprises a shelf board 12, connectors 14—14 at its opposite ends, and supports 16—16, the supports above the lowermost shelf comprising spacers for holding the shelves in spaced parallel relation and the supports at the lower side of the lowermost shelves constituting legs for supporting the structure on the floor and being provided with foot blocks 18—18.

Figure 4:
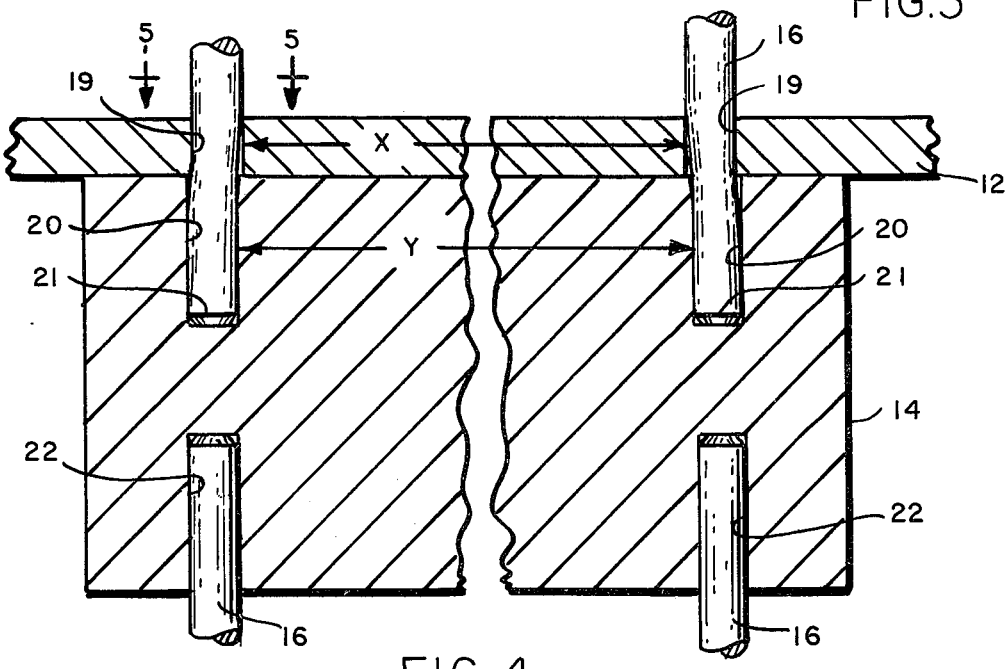
FIG. 4 is an enlarged section of the structure taken on the line 4—4 of FIG. 3.

Referring specifically to FIG. 4, the connectors 14 are in the form of rectangular blocks of suitable dimension, adapted to be arranged at the undersides of the shelves and contain at their upper sides pairs of vertically drilled holes 20—20 and at their lower side pairs of vertically drilled holes 22—22 for receiving, respectively, the lower ends of supports 16—16 above the shelves and the upper ends of the supports 16—16 below the shelves. The shelf boards 12 contain pairs of vertically drilled holes 19—19.

Figure 5:
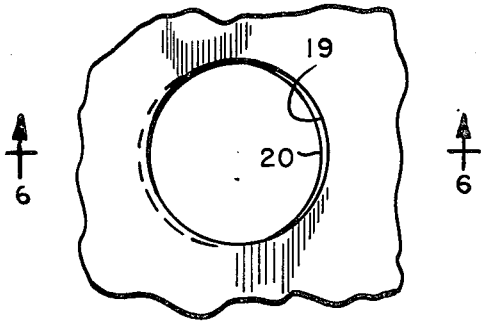
FIG. 5 is an enlarged plan view taken on the line 5—5 of FIG. 4.
Figure 6:
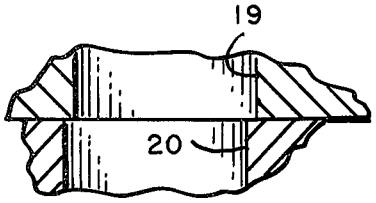
FIG. 6 is a fragmentary section taken on the line 6—6 of FIG. 5 showing the degree of eccentricity of the holes.

In accordance with this invention, the distance X between the pairs of holes 19—19 in the shelves and the distance Y between the pairs of holes 20—20, 22—22 in the connectors are slightly different. The distance X between the holes in the shelf may be slightly more or slightly less than the distance Y between the holes in the connector. The distance between the upper holes 20—20 in the connector and the lower holes 22—22 in the connector are the same. This arrangement is such that the holes in the shelves and the holes in the connector while lying one above another in the assembly are slightly eccentric, FIGS. 5 and 6, and so when the supports are inserted into the superimposed holes, the end portions of the supports are stressed in bending in opposite directions, FIG. 4, so as to be frictionally pressed into engagement with the side walls of the holes. The bending stress at the lower ends of the supports is effected by the offset relation of the holes 19 and 20 whereas the bending at the upper ends of the supports is effected by the offset relation of the holes 22 and 19.

For some applications, it may be desirable to bevel the upper and lower ends of the supports at 21 sufficiently to provide piloting means for driving the supports through the slightly misaligned holes. However, for most purposes, such beveling is not necessary.

The lower ends of the supports at the underside of the lowermost shelf as previously stated provides legs for the structure and these lower ends are designed to be set into foot blocks 18, the latter being provided with pairs of holes 23—23, the distance between which are slightly different from the holes at the underside of the connectors 14—14 thereabove so as to frictionally engage the lower ends of the legs in the foot blocks. Foot blocks may have pegs or sliders 25—25 at their opposite ends as indicated for engagement with the floor.

Figure 2:
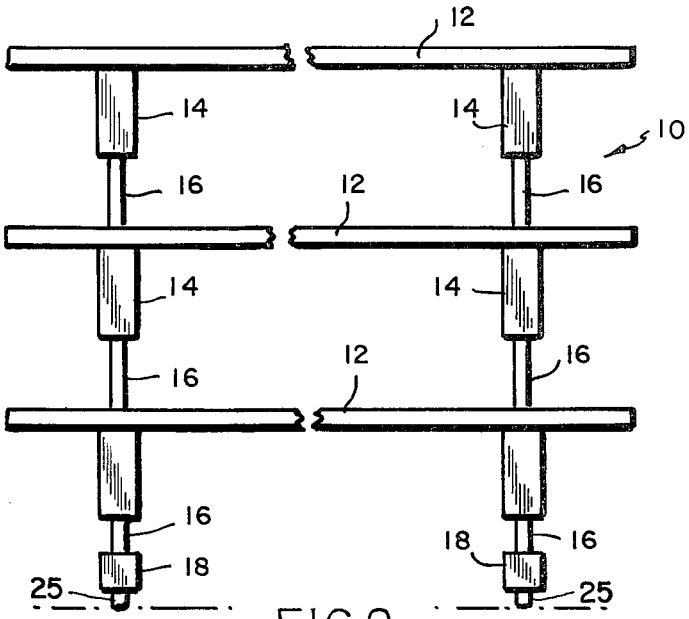
FIG. 2 is a front view of a structure partly broken away comprised of a number of superimposed modules, each of which comprises a shelf member, supports and connectors for mounting the shelf members to the supports.
Figure 3:
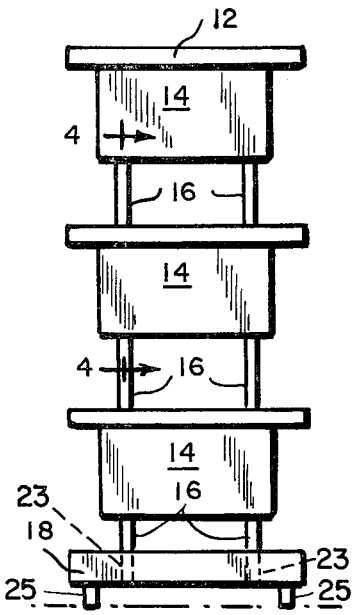
FIG. 3 is an end view of FIG. 1.

The shelves 12 may be made of any suitable material, natural or artificial, finished or unfinished, and as shown herein are rectangular in configuration. However, they may be square, oval or round shelves. The connectors 14 are blocks dimensioned to complement the structure and as is shown in front view, FIG. 2, are transversely much narrower than their depth from front to back as shown in FIG. 3. The depth from top to bottom is approximately half the distance between the shelves. However, the aforesaid dimensions are not considered to be limiting, but may be modified in any fashion which is consistent with attractiveness and utility. The supports 14 are shown as dowels of circular cross section. However, the cross section may be modified to change or enhance the appearance of the structure, in which case, the holes would be made of corresponding sections or the upper and lower ends of the dowels themselves would be turned down to circular cross section for reception in holes of circular cross section.

The joint as thus described is of simple construction, provides a rigid connection without fastening elements, provides for ease of assembling and disassembling the component parts of the furniture in which it is embodied and is particularly designed for modular furniture in that it enables adding or removing modules with the least amount of effort and trouble without the need for fastening elements and/or tools.

It should be understood that the present disclosure is for the purpose of illustration only and that this invention includes all modifications and equivalents falling within the scope of the appended claims.

I claim:

1. A multishelf structure comprising shelves containing at their opposite ends spaced vertically disposed holes, and means for supporting the shelves in spaced parallel relation, one above another, said means comprising spaced parallel columns at the opposite ends of the shelves, said columns extending continuously from the underside of one shelf upwardly through the holes in the one shelf to the underside of the shelf above, but not into the holes therein, and locking means comprising a block at each end of each shelf having contact with the lower side of the shelf, said blocks containing at their upper and lower sides spaced holes offset outwardly with respect to the holes in the shelves, the holes in the top side receiving the portions of the columns extending downwardly through a given shelf and the holes in the lower side receiving the portions of the columns extending upwardly from said shelf into the holes at the lower side of the blocks at the underside of the shelf above such that the shelf at the upper side of a block bends the columns inwardly and the block at the underside of the shelf above bends the columns outwardly.

2. A shelf module for building a multishelf structure of spaced, parallel shelves comprising a shelfboard containing at its opposite ends spaced, vertically disposed holes, spaced parallel columns inserted into the holes with portions extending from the underside of the shelfboard and portions extending from the upper side of the shelfboard, and locking means comprising blocks at the ends of the shelfboard at the lower side and having engagement with the lower side, said blocks containing spaced holes at their upper and lower sides, situated at a greater distance apart than the holes in the shelfboard, said holes at the upper side receiving the portions of the columns at the lower side of said shelf and bending the columns inwardly relative to the blocks, said module being adapted to be combined with like modules by inserting the portions of the columns extending upwardly from the shelf into the holes at the lower side of the blocks of a module above.

3. A shelf module according to claim 2 characterized in that the module can be easily assembled and disassembled.

* * * * *